United States Patent [19]

Woodall, Jr. et al.

[11] 4,404,999

[45] Sep. 20, 1983

[54] LOOP PILE FABRIC

[75] Inventors: Leigh C. Woodall, Jr., Roxboro; John T. Hayes, Durham; Robert G. Currier, Roxboro, all of N.C.

[73] Assignee: Collins & Aikman Corporation, New York, N.Y.

[21] Appl. No.: 373,709

[22] Filed: Apr. 30, 1982

[51] Int. Cl.[3] ..... D03D 27/00

[52] U.S. Cl. ..... 139/391; 428/17; 428/92; 66/194

[58] Field of Search ..... 139/391, 420 R, 402, 139/403, 397, 398; 428/92, 93, 94, 17; 66/170, 191, 192; 112/410; 29/120; 15/230.11

[56] References Cited

U.S. PATENT DOCUMENTS

| | | | |
|---|---|---|---|
| 3,180,115 | 4/1965 | Marshall | 66/170 |
| 3,308,522 | 3/1967 | Miller | 29/120 |
| 3,441,063 | 4/1969 | Press et al. | 139/391 |
| 3,837,988 | 9/1974 | Hennen et al. | 428/92 |
| 3,926,701 | 12/1975 | Nishiwaki | 66/194 X |
| 4,078,110 | 3/1978 | Fletcher et al. | 428/93 |
| 4,191,792 | 3/1980 | Janssen | 15/230.11 |
| 4,324,824 | 4/1982 | Narens et al. | 428/92 |

FOREIGN PATENT DOCUMENTS

| | | | |
|---|---|---|---|
| 283047 | 1/1971 | U.S.S.R. | 139/397 |

*Primary Examiner*—James Kee Chi

*Attorney, Agent, or Firm*—Bell, Seltzer, Park & Gibson

[57] ABSTRACT

This invention relates to a loop pile fabric comprising a backing fabric and resilient pile yarns interengaged with said backing fabric at spaced intervals and extending from one face thereof to form a pile comprised of a multiplicity of pile loops. The fabric is characterized by the pile loops extending substantially upright from the backing fabric and being randomly oriented relative to one another to provide a random appearance and a substantially non-directional grain to the pile. The fabric is further characterized by the density of the pile loops and the size of the pile yarns forming the pile loops being such that each pile loop has the major portion thereof out of contact with the adjacent surrounding pile loops and substantially the totality of each pile loop is readily visible to provide substantial void volume within the pile of the fabric.

19 Claims, 4 Drawing Figures

LOOP PILE FABRIC

The present invention relates to a pile fabric, and more particularly to a unique loop pile fabric of the type having a backing fabric or base with pile yarns interengaged with the backing fabric and extending therefrom to form a pile comprised of a multiplicity of pile loops.

A unique characteristic of the pile fabric of the present invention is that the pile loops extend substantially upright from the backing fabric and are so arranged that each pile loop has the major portion thereof out of contact with the adjacent surrounding pile loops and substantially the totality of each pile loop is readily visible. Moreover, the loops extend in a self-supporting upright orientation from the backing fabric and do not depend upon adjacent pile loops for support. The flexural properties of the pile loops permit the loops to be moved from the upright orientation when pressure is applied to the fabric, but upon removal of pressure, the loops are resiliently urged back to the upright orientation.

Another unique characteristic of the present invention is that the upright pile loops are nonaligned and randomly oriented relative to one another to provide a random appearance and a substantially nondirectional grain to the pile. More particularly, the pile loops are arranged in rows, with the pile loops in each row being staggered or offset from the pile loops in adjacent rows on each side thereof to provide a nonaligned orientation to the respective pile loops. To further contribute to the random appearance of the pile, the individual pile loops assume various contorted configurations, with a majority of the pile loops having the pile yarn thereof disposed in a nonplanar configuration.

Preferably, the pile yarns forming the pile loops are monofilaments, and may suitably have a diameter of from 9 to 36 mils. An especially preferred type of monofilament pile yarn for use in the present invention is of a sheath-core construction and comprises a multifilament core and a polymeric coating forming a continuous sheath about the core.

In a preferred embodiment, as illustrated and described more fully herein, the loop pile fabric is of a woven construction and comprises a woven backing fabric formed of ground warp yarns interwoven with weft yarns, and warpwise extending resilient monofilament pile yarns arranged between certain adjacent ground warp yarns and being interwoven at spaced intervals with the weft yarns and extending from the backing fabric to form warpwise rows of pile loops.

The characteristics and features of the pile fabric of the present invention make this fabric particularly well suited for use as floor coverings or mats. The upright resilient pile loops and the substantially nondirectional pile are effective in removing dirt, moisture and grime from the shoes of persons passing over the mat, while the relatively open nature of the pile and its relatively high void volume are capable of receiving and holding these materials between cleanings. The fabric also lends itself for use as a paint applicator, particularly for texture painting using viscous paint materials, where the substantial void volume of the pile and the resilient nature of the pile loops contribute to excellent paint holding and release characteristics. Numerous other applications and uses for the pile fabric of this invention may be envisioned by persons skilled in the art.

BRIEF DESCRIPTION OF THE DRAWINGS

Some of the features and advantages of the invention having been stated, others will become apparent as the description proceeds, when taken in connection with the accompanying drawings, in which.

DESCRIPTION OF ILLUSTRATED EMBODIMENT

Figure 3:
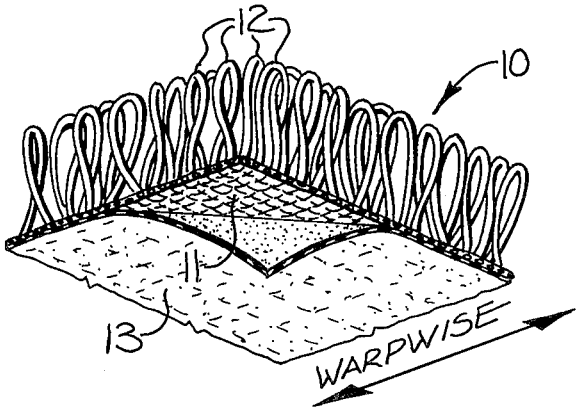
FIG. 3 is a diagrammatic perspective view showing the underside of the fabric.

Referring now in more detail to the drawings, the reference character 10 generally indicates a loop pile fabric in accordance with the present invention. The pile fabric includes a baking fabric or base 11 and pile yarns P interengaged with the backing fabric at spaced intervals and extending from one face of the backing fabric 11 to form a pile comprised of a multiplicity of upright open pile loops, indicated generally by the reference character 12. The fabric also preferably includes a back coating 13 (FIG. 3) of latex or other suitable material, which assists in securing the pile loops 12 in place and also contributes to the dimensional stability of the fabric.

As illustrated, the pile loops 12 extend in a self-supporting upright orientation from the backing fabric 11, without depending for support upon the adjacent surrounding pile loops 12. Moreover, the density of the pile loops, together with the size of the pile yarns, are such that substantially the entire loop 12 is readily visible, and indeed, even the underlying backing fabric 11 is not obscured from view by the pile loops 12, as is readily evident from FIG. 1.

Preferably, the construction of the fabric is such that the pile loops are present at a density of from about 50 to about 150 pile loops per square inch. This relatively sparse density of the pile loops, and the relatively small diameter of the pile yarns in relation to the size of the loops, serve to provide a substantial void volume within the pile of the fabric. This makes the fabric particularly well suited for use as a floor covering or mat, with the upper surfaces of the pile loops serving to scrape or brush dirt from the shoes of people passing over the mat, and with the large void volume of the pile serving to receive and collect the dirt. The large void volume of the pile also contributes significantly to the usefulness of the fabric for other purposes, such as for a paint applicator for example, where the open nature of the loops and the substantial void volume allows the fabric to receive and hold a significant amount of paint therein.

For applications such as those noted above, it is preferred that the void volume of the fabric be at least 85%, and desirably higher. The percent void volume of the fabric may be defined as the percentage of the volume of the pile portion of the fabric which is not occupied by the pile yarns. This may be determined mathematically by calculating the total volume of a unit area of fabric and subtracting from that the volume of the backing fabric to thereby obtain the volume of the pile portion of the fabric. The volume occupied by the pile yarns may be calculated from the diameter of the pile yarn, the average length of the pile yarn in each loop, and the number of pile loops per unit area. These calculations assume the fabric to be in a flat configuration. By way of example, for a woven pile fabric having the specifications listed below, the void volume was calculated to be 94%.

| | |
|---|---|
| Total thickness of fabric | .355 inch |
| Thickness of woven backing | .040 inch |
| Pile density | 97 loops/sq. in. |
| Pile yarn diameter | 18 mils |
| Average length of pile yarn in one loop | .730 inch |

In the preferred construction illustrated, it will be noted that the pile loops 12 defined by the pile yarns P include leg portions 19 (FIG. 4) which extend from the backing fabric at spaced apart locations, forming the pile loops 12 therebetween. At the uppermost portion of the loop, the pile yarn P forms a generally U-shaped bight portion 20. As illustrated, the bight portions 20 of the respective loops are disposed a substantially uniform distance from the backing fabric such that the loops collectively form a substantially uniform height pile throughout the fabric.

Figure 1:
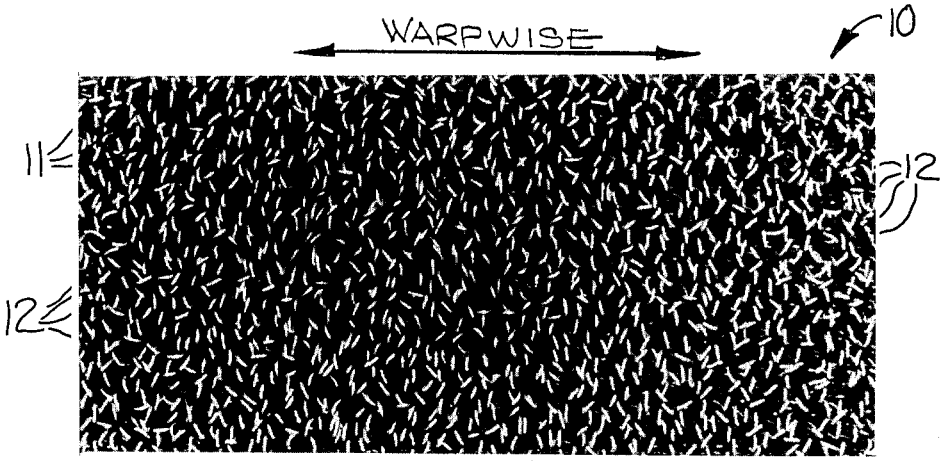
FIG. 1 is a photograph showing a top plan view of the loop pile fabric of the present invention.
Figure 2:
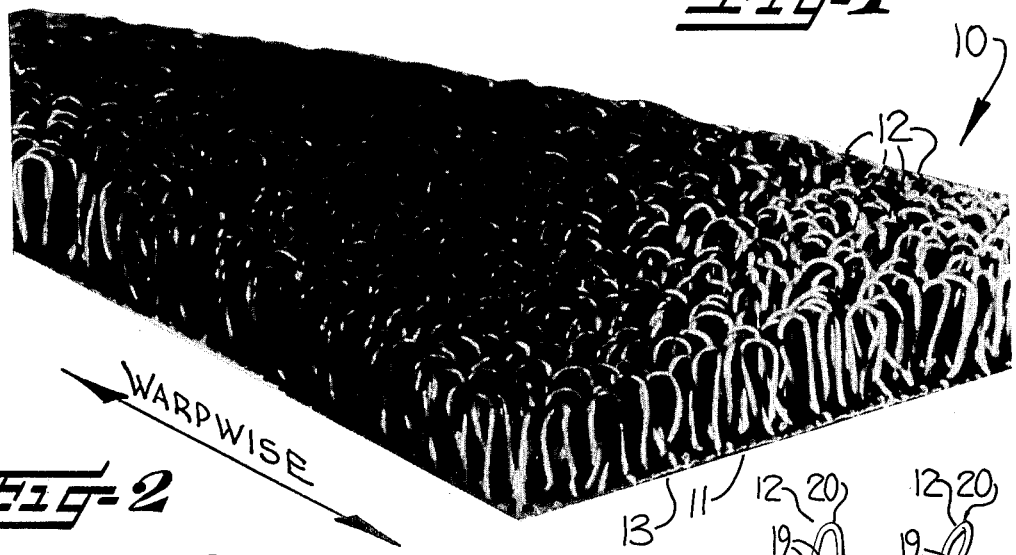
FIG. 2 is a photograph showing an enlarged top perspective view of the fabric.

A distinguishing feature of the pile fabric of the present invention is that the pile loops 12 which form the pile, while extending substantially upright from the backing fabric 11, are randomly oriented relative to one another as is seen clearly in FIGS. 1 and 2. The loops thus provide a random appearance and a substantially nondirectional grain to the pile. From viewing the photographs of FIGS. 1 and 2 and the schematic illustration of FIG. 4, it will be seen that the random orientation of the pile loops with respect to one another is brought about largely by the pile loops assuming random nonuniform shapes and contorted configurations. Moreover, it will be seen that the pile yarns forming some of the loops are twisted into a nonplanar configuration, while other loops are of a nontwisted substantially U-shaped configuration. It will be clearly seen however that the majority of the pile loops in the pile have a nonplanar, twisted configuration and those loops that do twist tend to twist in the same direction, although to varying degrees.

Further, while the pile loops are arranged in rows lengthwise of the fabric, the loops of adjacent rows are arranged in staggered relationship so as to provide a nonaligned appearance to the respective pile loops. More specifically, the pile loops in any given row are staggered or offset relative to the pile loops in adjacent rows on each side thereof, and with the loops in those adjacent rows also being staggered or offset relative to one another.

Additionally, while each loop 12 extends substantially upright such that its bight portion 20 lies in a plane substantially perpendicular to the base fabric 11, the random orientation of the respective loops causes the planes of at least a majority of the pile loop bight portions 20 to be nonaligned and nonparallel. This can be seen most clearly in FIG. 1, where the bight portions of the respective loops are most evident. It will thus be seen that the surface appearance presented by the bight portions 20 of the pile loops 12 is of a random, nonuniform nature.

The pile yarns P used in the pile fabric are selected for the flexural properties which they impart to the pile fabric. More specifically, the flexural properties of the pile yarns are such that the pile loops extend normally in a self-supporting upright orientation from the backing fabric. When pressure is applied to the surface of the pile fabric, the pile loops can be readily moved from the upright orientation toward a flattened position. However, as soon as pressure is released, the resilient nature of the pile yarns causes the pile loops to return to an upright orientation.

Preferably, and as illustrated, the pile yarns are monofilaments. The monofilament pile yarns desirably have a diameter within the range of from 9 mils to about 36 mils. An especially suitable type of monofilament pile yarn for use in the present invention, because of its strength and its resilient flexural properties, is a monofilament yarn of a sheath-core construction comprising a multifilament core and a polymeric coating forming a continuous sheath about the core. The core is preferably formed of continuous multifilament polyester, and the surrounding polymeric coating is of a flexible polymeric material such as polyvinyl chloride for example. The polymeric sheath may be pigmented to provide various colors to the pile, and the multifilament core may be dyed a color similar to or matching the color of the sheath coating. This is especially desirable where the fabric is used as a mat in high traffic areas, so as to maintain a fresh appearance to the mat, even when the sheath is worn away to expose the multifilament core.

In the preferred embodiment of the invention illustrated, the loop pile fabric 10 is of a woven construction, but those skilled in the art will recognize that many of the features and advantages of the illustrated embodiment can be realized from other pile fabric constructions having a backing fabric with pile yarns extending therefrom.

Figure 4:
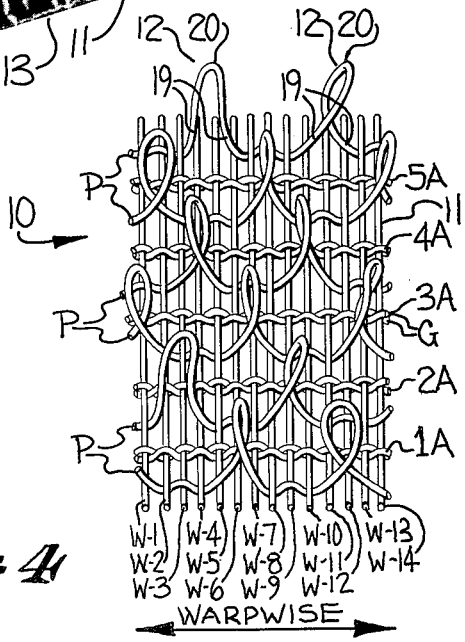
FIG. 4 is a schematic illustration of the weave structure of the fabric.

Referring more specifically to the weave construction of the fabric, it will be seen from FIG. 4 that the backing fabric or base 11 is woven from ground warp yarns G in the form of chain warp yarns, interwoven with weft yarns W. The pile yarns P extend warpwise and are interwoven at spaced intervals with the weft yarns and extend from the backing fabric to form warpwise rows of pile loops. The warpwise extending pile yarns P are separated from adjacent pile yarns by a plurality of the ground warp yarns. In the particular weave construction illustrated, six pick or weft yarns W are involved in the formation of each successive pile loop in each warpwise row of the pile loops.

To insure that the pile yarns P are securely anchored to the backing fabric 11 between successive pile it is desirable that a plurality of the weft yarns W be interwoven with the pile yarns P between each of the pile loops 12. In the illustrated embodiment, the pile yarns P are interwoven with at least three adjacent weft yarns W of the backing fabric. The pile yarn P in each warpwise row of pile loops 12 extends under the two weft yarns W nearest the leg portions 19 of two warpwise adjacent pile loops 12 and extends over the weft yarn W located between the latter two weft yarns.

Additionally, it will be seen that each of the pile loops extends over and across a plurality of successive weft yarns such that the leg portions 19 of the pile yarn P forming each pile loop 12 extend from the backing fabric at spaced apart locations so as to enhance the openness of the pile loops and assist in providing substantial void volume in the pile. In the particular construction illustrated, it will be seen that each pile loop extends over and across three successive weft yarns W.

As illustrated in FIG. 4, the warpwise rows of pile loops are arranged in alternation with pairs of the ground warp yarns G, although a greater number of ground warp yarns may be provided between adjacent warpwise rows of pile loops, if desired. In order to enhance the random surface appearance of the pile fabric and avoid leaving gaps, the pile loops formed by adjacent pile yarns P, rather than being arranged in weftwise rows, are staggered throughout the fabric, such that the pile loops in each warpwise row are offset warpwise from the pile loops in weftwise adjacent rows on each side thereof. In the particular weave construction illustrated, six warpwise rows of pile loops are required to complete a repetitive pattern weftwise of the fabric.

To further enhance the irregular relative disposition of the pile loops and the random appearance of the pile, it will be seen that in the preferred embodiment of the invention illustrated, not only are the pile loops in the warpwise rows staggered or offset with respect to the pile loops in adjacent rows on each side thereof, but the extent to which the pile loops in some of the warpwise rows is offset relative to the pile loops in certain adjacent rows varies in some instances such that the pile loops in certain warpwise rows are offset an even number of picks from the pile loops in the adjacent row, and the loops in certain other warpwise rows are offset an odd number of picks from the pile loops in the adjacent row. As seen in FIG. 4, for example, while six picks are involved in the formation of each successive pile loop 12, it can be seen that two adjacent pile loops in the first or lowermost row 1A of FIG. 4 are formed over weft yarns W5, W6, W7 and W11, W12, W13, while adjacent pile loops 17 in the next warpwise row 2A are formed over the weft yarns W2, W3, W4 and W8, W9, W10. Thus the loops in row 2A are staggered or offset from the loops 12 in row 1A by an odd number of weft yarns, namely 3, which corresponds to one-half the number of weft yarns required to form a pile loop 17 in any given row. However, the pile loops 17 in the next adjacent warp-wise row 3A are offset in the same direction from the loops of row 2A by an even number, i.e. by only two weft yarns. The extent of offset between the pile loops 17 of row 4A relative to the loops of row 3A is the same as that between row 2A and 1A, namely three weft yarns.

In the drawings and specification there has been set forth a preferred embodiment of the invention, and while specific terms are employed to aid in understanding the invention, they are used in a generic and descriptive sense only and not for purposes of limitation.

That which is claimed is:

1. A pile fabric comprising a woven backing fabric and pile yarns interwoven with said backing fabric at spaced intervals and extending from one face thereof to form a pile comprised of a multiplicity of pile loops, the pile loops being arranged in rows lengthwise of the fabric with the pile loops in any given row being staggered relative to the pile loops in the adjacent rows on each side thereof and with the loops in said adjacent rows also being staggered relative to one another to provide a nonaligned appearance to the respective pile loops, the pile loops extending substantially upright from the backing fabric and being randomly oriented relative to one another to provide a random appearance and a substantially nondirectional grain to the pile, and the density of the pile loops and the size of the pile yarns forming the pile loops being such that each pile loop has the major portion thereof out of contact with the adjacent surrounding pile loops and substantially the totality of each pile loop is readily visible to provide substantial void volume within the pile of the fabric.

2. A pile fabric according to claim 1 wherein a majority of the pile loops have the pile yarn thereof disposed in a nonplanar configuration to enhance said random orientation to the pile loops.

3. A pile fabric according to claim 2 wherein said majority of the pile loops are disposed in a twisted configuration.

4. A pile fabric comprising a backing fabric and pile yarns interengaged with said backing fabric at spaced intervals and extending from one face thereof to form a pile comprised of a multiplicity of pile loops, the pile loops being arranged in rows lengthwise of the fabric with the pile loops in any given row being staggered relative to the pile loops in the adjacent rows on each side thereof and with the loops in said adjacent rows also being staggered relative to one another to provide a nonaligned appearance to the respective pile loops, the pile yarn forming the pile loops extending from the backing fabric at spaced apart locations imparting an open configuration to the pile loops, and the pile loops extending substantially upright from the backing fabric, a majority of the pile loops having the pile yarn thereof disposed in a nonplanar configuration such that the pile loops are randomly oriented relative to one another to provide a random appearance and a substantially nondirectional grain to the pile, and said pile loops being present at a density of from about 50 to about 150 loops per square inch, the density of the pile loops and the size of the pile yarns forming the pile loops being such that each pile loop has the major portion thereof out of contact with the adjacent surrounding pile loops and substantially the totality of each pile loop is readily visible to provide substantial void volume within the pile of the fabric.

5. A pile fabric according to claim 4 wherein each of the upright pile loops forms a bight portion lying in a plane substantially perpendicular to the base fabric, and wherein the bight portions of the respective pile loops are located a substantially uniform distance above the backing fabric to thereby define a substantially uniform height pile.

6. A pile fabric according to claim 5 wherein the upright pile loops are randomly oriented with the planes of at least a majority of the pile loop bight portions being nonparallel.

7. A pile fabric according to claim 1 or 4 wherein each of said pile yarns comprises a monofilament with a diameter of from 9 to 36 mils.

8. A pile fabric comprising a backing fabric and resilient monofilament pile yarns interengaged with said backing fabric at spaced intervals and extending from one face thereof to form a pile comprised of a multiplicity of pile loops, the pile loops being arranged in rows lengthwise of the fabric with the pile loops in any given row being staggered relative to the pile loops in adjacent rows on each side thereof and with the loops in said acjacent rows also being staggered relative to one another to provide a nonaligned appearance to the respective pile loops, the pile loops extending substantially upright from the backing fabric and being randomly oriented relative to one another to provide a random appearance and a substantially nondirectional grain to the pile, said monofilament pile yarns each having a diameter of from 9 to 36 mils and providing such flexural properties to the pile loops that the loops normally extend in a self-supporting, upright orientation from the backing fabric and are resiliently urged to such upright orientation upon the removal of pressure applied to the surface of the pile fabric, and wherein the density of the pile loops and the size of the pile yarns forming the pile loops are such that each pile loop has the major portion thereof out of contact with the adjacent surrounding pile loops and substantially the totality of each loop is readily visible to provide substantial void volume within the pile of the fabric.

9. A pile fabric according to claim 8 wherein said monofilament pile yarns each comprises a multifilament core and a polymeric coating forming a continuous sheath about the core.

10. A pile fabric according to claim 9 wherein the multifilament core of the pile yarns is of a color substantially the same as that of the polymeric coating.

11. A pile fabric comprising a woven backing fabric formed of ground warp yarns interwoven with weft yarns, and warpwise extending resilient monofilament pile yarns arranged between certain adjacent ground warp yarns and being interwoven at spaced intervals with said weft yarns and extending from the backing fabric to form warpwise rows of pile loops, said monofilament pile yarns each having a diameter of from 9 mils to 36 mils and providing such flexural properties to the pile loops that the loops normally extend in a self-supporting, upright orientation from the backing fabric and are resiliently urged to such upright orientation upon the removal of pressure applied to the surface of the pile fabric and wherein the pile loops are spaced apart from one another such that each pile loop has the major portion thereof out of contact with the adjacent surrounding pile loops and substantially the totality of each loop is readily visible to provide substantial void volume within the pile of the fabric.

12. A pile fabric according to claim 11 wherein each of said pile loops extends over and across a plurality of successive weft yarns such that the leg portions of the pile yarn forming each pile loop extend from the backing fabric at spaced apart locations and impart an open configuration to the pile loop.

13. A pile fabric according to claim 11 wherein a plurality of weft yarns are interwoven with the pile yarns between each of the pile loops so as to firmly anchor the pile loops to the backing fabric.

14. A pile fabric according to claim 13 wherein at least three adjacent weft yarns of the backing fabric are interwoven with the pile yarns between each of the pile loops, and each of said pile loops extends over and across a plurality of successive weft yarns.

15. A pile fabric according to claim 11 wherein the pile loops in each warpwise row are offset from the pile loops in adjacent rows on each side thereof.

16. A pile fabric according to claim 11 wherein adjacent warpwise rows of pile loops are separated by a plurality of said ground warp yarns.

17. A pile fabric comprising a woven backing fabric formed of ground warp yarns interwoven with weft yarns, and warpwise extending pile yarns arranged between certain adjacent warp yarns and being interwoven at spaced intervals with said weft yarns and extending from the backing fabric to form warpwise rows of pile loops, the pile loops in each warpwise row being offset from the pile loops in adjacent rows on each side thereof to provide a nonaligned appearance to the respective pile loops, and the pile loops being randomly oriented relative to one another to provide a random appearance and a substantially nondirectional grain to the pile, and each of the pile loops extending over and across a plurality of successive weft yarns and forming loops of an open configuration with the leg portions of the pile yarn forming each pile loop extending from the backing fabric at spaced apart locations and with the density of the pile loops causing the major portion of each pile loop to be out of contact with the adjacent pile loops with substantially the totality of each loop being readily visible and with substantial void volume within the pile of the fabric, and wherein each of said pile yarns comprises a multifilament core and a polymeric coating forming a continuous sheath about the core and presenting the appearance of a monofilament pile yarn, said multifilament cores and sheath coatings cooperating to provide such flexural properties to the pile loops that the loops normally extend in a self-supporting upright orientation from the backing fabric and are resiliently urged to such upright orientation upon the removal of pressure to the surface of the pile fabric.

18. A pile fabric according to claim 17 wherein said pile loops are present at a density of from about 50 to 150 loops per square inch.

19. A pile fabric according to claim 17 wherein the pile loops in certain warpwise rows are offset an even number of picks from the pile loops in the adjacent row, and the loops in certain other warpwise rows are offset an odd number of picks from the pile loops in the adjacent row.

* * * * *

UNITED STATES PATENT AND TRADEMARK OFFICE

CERTIFICATE OF CORRECTION

PATENT NO. : 4,404,999

DATED : September 20, 1983

INVENTOR(S) : Leigh C. Woodall, Jr., et al

It is certified that error appears in the above-identified patent and that said Letters Patent is hereby corrected as shown below:

Column 2, line 21, "baking" should be --backing--.

Claim 8, Column 6, line 59, "acjacent" should be --adjacent--.

Claim 17, Column 8, line 12, "adjacent warp yarns" should be --adjacent ground warp yarns--.

Signed and Sealed this

*Sixth* Day of *December 1983*

[SEAL]

*Attest:*

GERALD J. MOSSINGHOFF

*Attesting Officer*

*Commissioner of Patents and Trademarks*